United States Patent [19]

Dörling et al.

[11] 4,258,781

[45] Mar. 31, 1981

[54] SUSPENSION FOR A THERMALLY HEAVY LOAD CYLINDRICAL PIPE ASSEMBLY

[75] Inventors: Rolf Dörling; Hans Hemschemeier, both of Gummersbach, Fed. Rep. of Germany

[73] Assignee: L. & C. Steinmüller GmbH, Gummersbach, Fed. Rep. of Germany

[21] Appl. No.: 960,834

[22] Filed: Nov. 15, 1978

[30] Foreign Application Priority Data

Nov. 15, 1977 [DE] Fed. Rep. of Germany ..... 2750924

[51] Int. Cl.[3] ..... F28F 9/00

[52] U.S. Cl. ..... 165/67; 165/134 R; 165/140

[58] Field of Search ..... 165/134, 67, 140, 162

[56] References Cited

U.S. PATENT DOCUMENTS

| | | | |
|---|---|---|---|
| 2,268,730 | 1/1942 | Vagt | 165/67 |
| 2,797,297 | 6/1957 | Nihlen | 165/134 |
| 3,001,766 | 9/1961 | Laist | 165/140 |
| 3,026,256 | 3/1962 | Liljeblad et al. | 165/134 |
| 3,442,060 | 5/1969 | Guillot et al. | 165/134 |
| 3,610,329 | 10/1971 | Markert et al. | 165/134 |
| 3,857,442 | 12/1974 | Westinghouse | 165/134 |

FOREIGN PATENT DOCUMENTS

| | | | |
|---|---|---|---|
| 2132817 | 11/1972 | France | 165/67 |

*Primary Examiner*—Sheldon Richter
*Attorney, Agent, or Firm*—Becker & Becker, Inc.

[57] ABSTRACT

A suspension for a thermally heavy load cylindrical pipe assembly of relatively large diameter, according to which the suspension includes a plate with chambers therein. This plate is at its circumference provided with inlets for a cooling medium, while above the plate there are provided pipes which while extending parallel to the axis of the pipe assembly communicate with the chambers. These pipes lead into collecting elements which in their turn are firmly connected to a hollow supporting ceiling or roof structure which is likewise cooled and which is arranged above the pipe assembly.

1 Claim, 4 Drawing Figures

SUSPENSION FOR A THERMALLY HEAVY LOAD CYLINDRICAL PIPE ASSEMBLY

The present invention relates to a suspension for a thermally highly loaded cylindrical suspended pipe assembly of relatively large diameter.

With collimator furnaces, process technical pipe assemblies are utilized. These pipe assemblies are under a high thermal load and therefore require, in particular when they are suspended, a supporting structure for the suspension which permits an effective cooling.

It is, therefore, an object of the present invention to provide a suspension for a pipe assembly of the just mentioned type which, while fully meeting the requirements concerning the suspension, will permit a safe cooling.

This object and other objects and advantages of the invention will appear more clearly from the following specification in connection with the accompanying drawings, in which:

FIG. 1 diagrammatically illustrates a longitudinal section through a collimator furnace which is provided with a suspension according to the invention for the pipe assembly.

The suspension according to the present invention is characterized primarily in that it comprises a plate with hollow spaces which at its circumference is provided with inlets for a cooling medium. The plate is at its upper surface provided with pipes which extend parallel to the axis of the pipe assembly and which are connected to the hollow spaces of the plate. These last mentioned pipes lead into collecting elements which in their turn are firmly connected to a hollow supporting ceiling or roof structure which is likewise cooled and which is arranged above the pipe assembly.

According to a preferred embodiment of the invention it is furthermore suggested that as cooling medium for the plate, for the pipes and the hollow supporting structure there is employed at least a portion of the cooled down heat carrier gas of a high temperature reactor.

Figure 1:
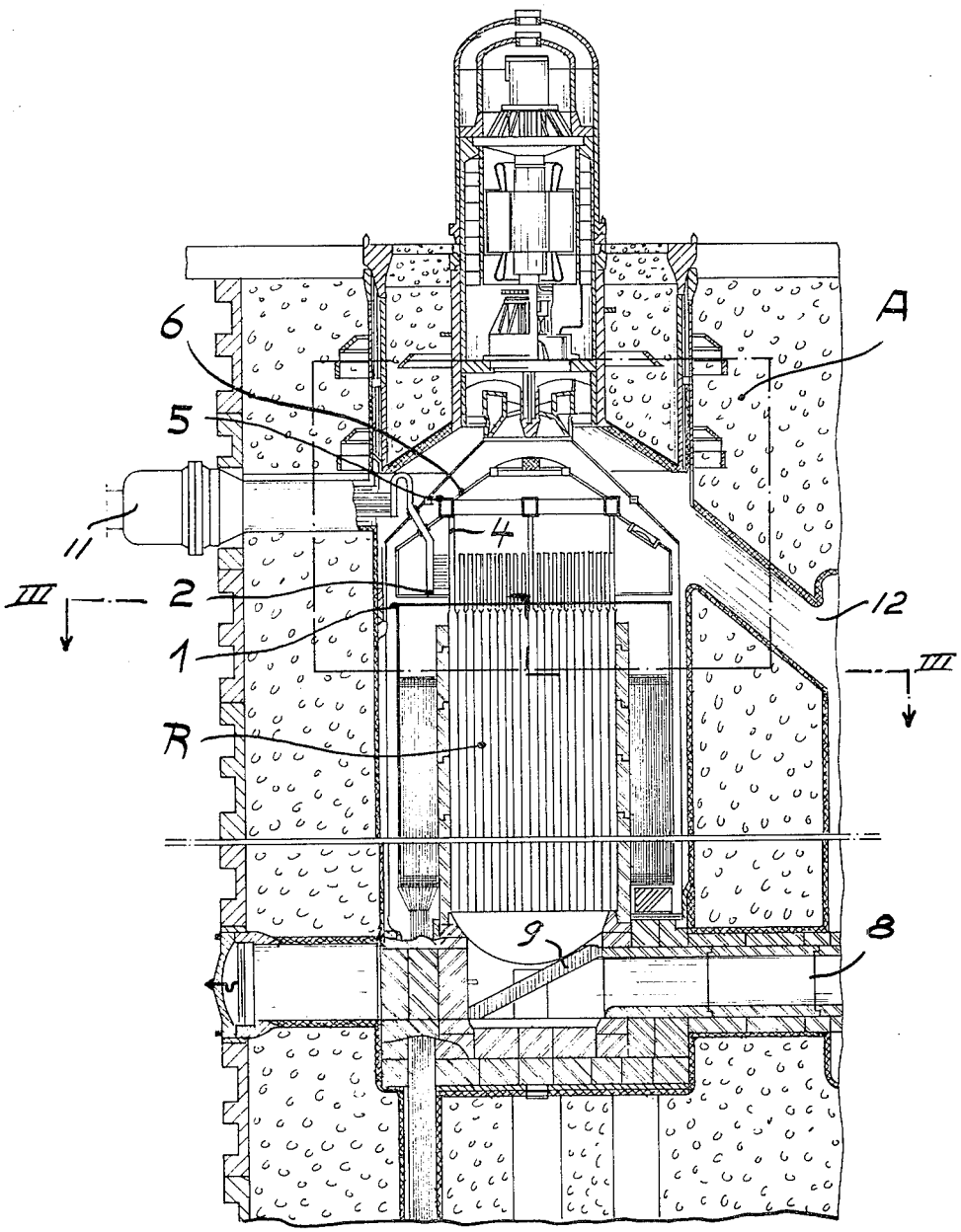
Figure 2:
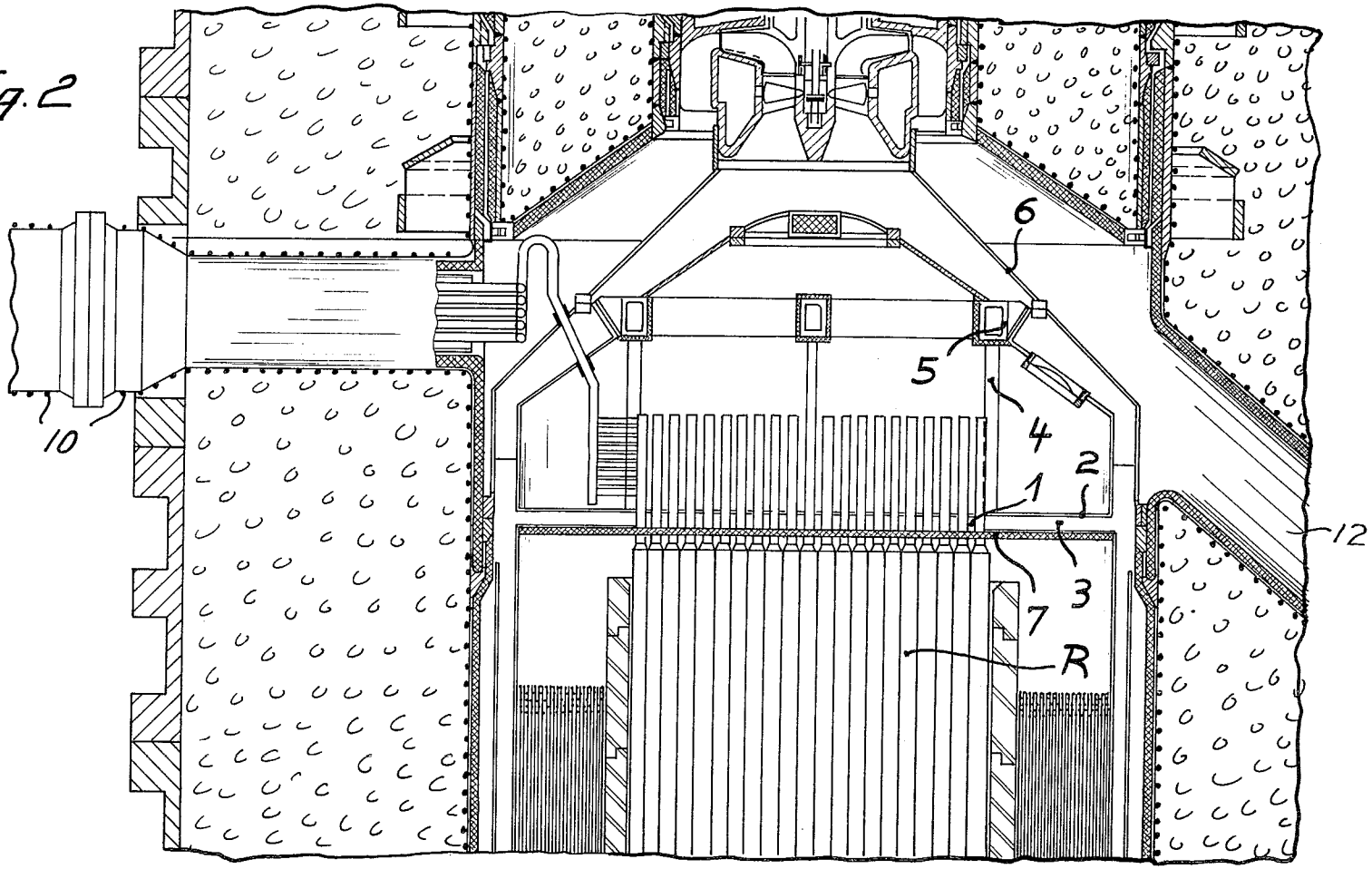
FIG. 2 illustrates on a larger scale than that of FIG. 1 the rectangle marked in dot-dash lines in FIG. 1 and designated with the letter A.
Figure 3:
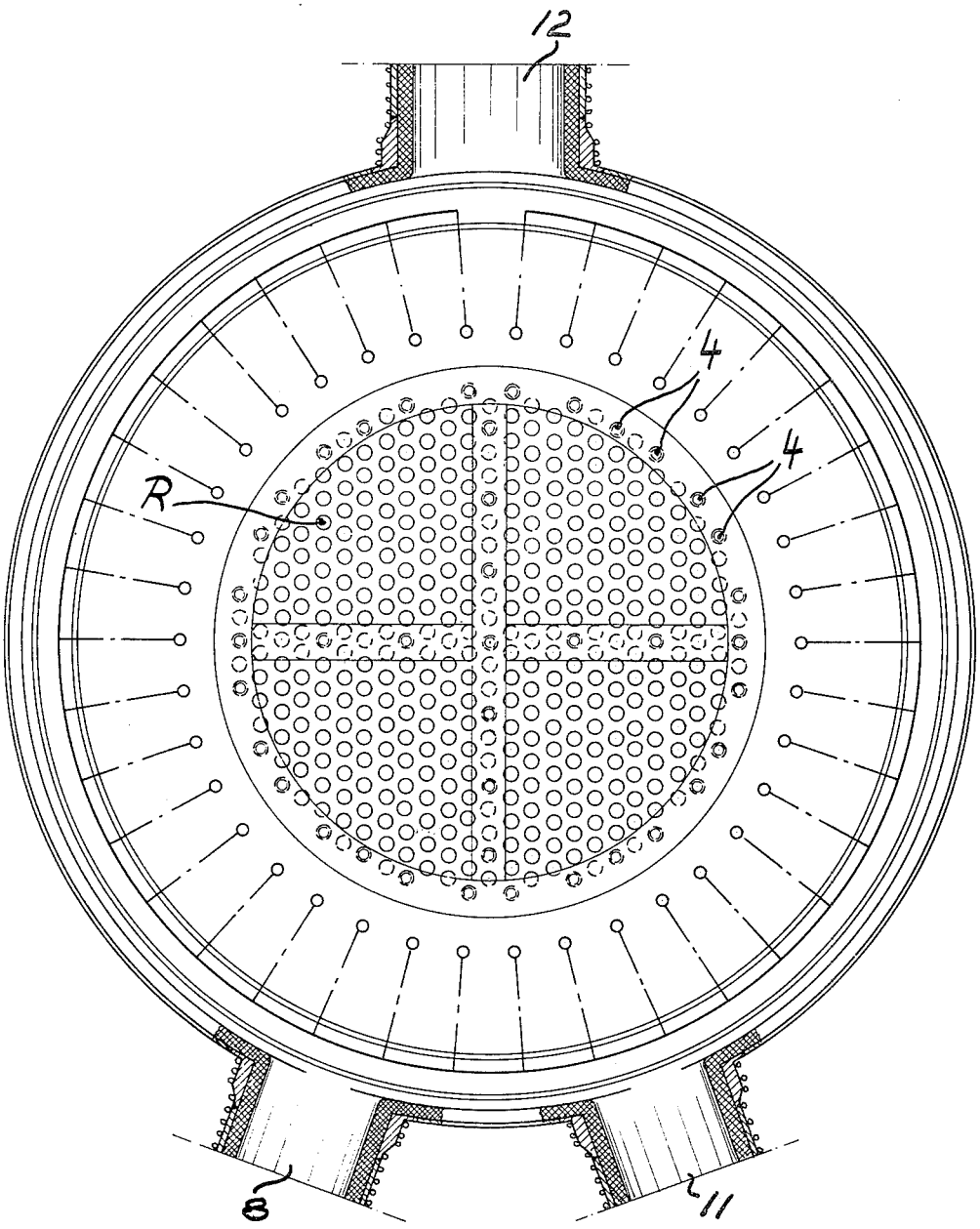
FIG. 3 represents a section taken along the line III—III of FIG. 1 but on a larger scale than that of FIG. 1.
Figure 4:
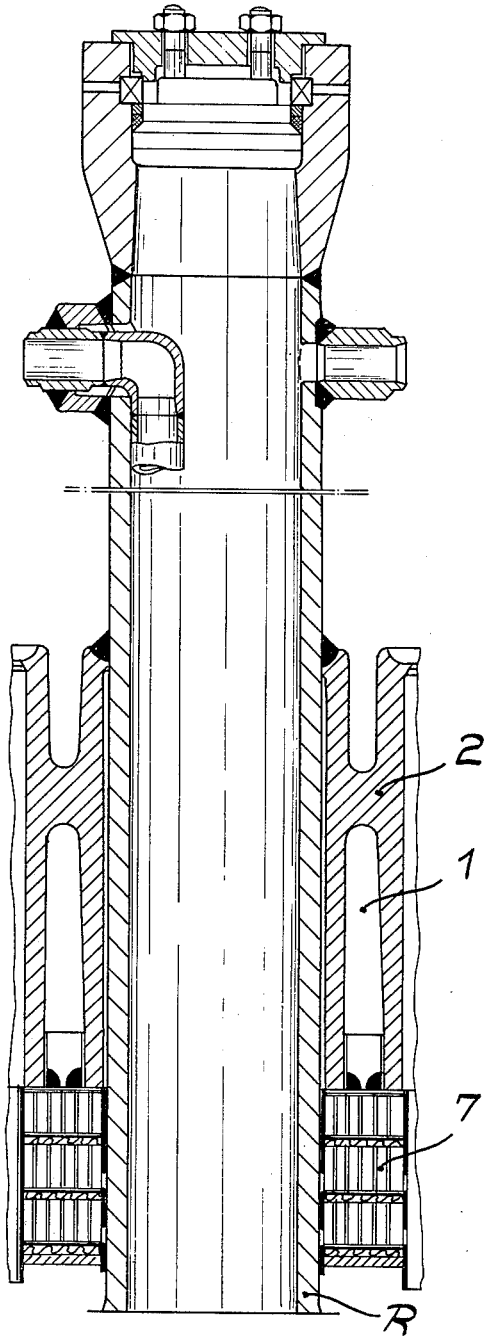
FIG. 4 illustrates on a larger scale than that of FIG. 1 the passages for a pipe of the pipe assembly through the supporting plate.

Referring now to the drawings in detail, the pipe assembly R which is intended for a thermal high load, comprises a plate 2 (FIG. 4) which is provided with hollow spaces 1. Below the plate 2 there is provided a heat insulating layer 7. In the outer circumference of plate 2 there are provided inlets 3 (FIG. 2) for the cooling medium. Supporting pipes 4 extend upwardly from the plate 2 and lead into collecting elements 5. The collecting elements 5 in turn are frictionally connected to the cooled hollow supporting ceiling or roof structure 6 for conveying the cooling medium.

The arrangement illustrated in the drawings furthermore comprises a gas inlet 8 for receiving hot gas from the nuclear reactor. The thus admitted gas passes over a gas distributing device 9 for uniformly distributing the gas over the entire pipe assembly. The arrangement furthermore comprises a cooling pipe system 10 for the process gas exit 11, and also comprises a cold gas (helium) outlet 12 e.g. to a high temperature reactor such as a torium high temperature reactor (H.T.R.)

As will be evident from the above, the advantages obtained by the arrangement according to the present invention consist primarily in that a thermally highly loaded pipe assembly of relatively large diameter and relatively great weight can be suspended in a proper way while the parts and the costs of construction for this purpose are relatively few and low respectively.

It is, of course, to be understood that the present invention is, by no means, limited to the particular showing in the drawings but also encompasses any modifications within the scope of the appended claims.

What we claim is:

1. A suspension for a thermally high load cylindrical pipe assembly, which includes: a plate comprising means forming chambers and having its periphery provided with inlets for connection with a supply of cooling medium, a plurality of pipes arranged above said plate and extending substantially parallel to the axis of said pipe assembly and being in communication with said chambers, a plurality of collecting elements, and a hollow supporting ceiling structure arranged above said pipe assembly and having said plurality of pipes firmly connected thereto, said hollow supporting ceiling being in communication with the plurality of pipes via the collecting elements.

* * * * *